US009261891B2

(12) United States Patent
Wen et al.

(10) Patent No.: US 9,261,891 B2
(45) Date of Patent: Feb. 16, 2016

(54) REFERENCE VOLTAGE GENERATING CIRCUITS

(71) Applicant: Nuvoton Technology Corporation, Hsinchu (TW)

(72) Inventors: Wen-Ying Wen, Zhudong Township, Hsinchu County (TW); Tzong-Liang Chen, Zhubei (TW)

(73) Assignee: NUVOTON TECHNOLOGY CORPORATION, Hsinchu Science Park (TW)

( * ) Notice: Subject to any disclaimer, the term of this patent is extended or adjusted under 35 U.S.C. 154(b) by 330 days.

(21) Appl. No.: 14/075,399

(22) Filed: Nov. 8, 2013

(65) Prior Publication Data

US 2015/0022178 A1 Jan. 22, 2015

(30) Foreign Application Priority Data

Jul. 16, 2013 (TW) ..... 102125349 A

(51) Int. Cl.
*G05F 1/46* (2006.01)
*G05F 3/30* (2006.01)

(52) U.S. Cl.
CPC . *G05F 1/468* (2013.01); *G05F 3/30* (2013.01)

(58) Field of Classification Search
None
See application file for complete search history.

(56) References Cited

U.S. PATENT DOCUMENTS

| | | | |
|---|---|---|---|
| 5,982,201 | A | 11/1999 | Brokaw et al. |
| 7,944,280 | B2 | 5/2011 | Gabillard et al. |
| 8,358,119 | B2 | 1/2013 | Kim |

FOREIGN PATENT DOCUMENTS

| | | |
|---|---|---|
| CN | 101995901 A | 3/2011 |
| TW | 200629033 | 8/2006 |
| TW | 200715091 | 4/2007 |
| TW | 200925823 | 6/2009 |
| TW | 200951669 | 12/2009 |

OTHER PUBLICATIONS

Zhuoya, Zhu et al., Current-summing mode low power Bandgap voltage reference, Journal of Southeast University (National Science Edition) Nov. 2003, pp. 717-720.

Office Action issued on Dec. 30, 2014 by the Taiwanese Patent Office in corresponding TW Patent Application No. 102125349.

*Primary Examiner* — Timothy J Dole

*Assistant Examiner* — Monica Mata

(74) *Attorney, Agent, or Firm* — Muncy, Geissler, Olds & Lowe, P.C.

(57) ABSTRACT

A reference voltage generating circuit. A bandgap circuit includes a current mirror circuit and an output circuit. The current mirror circuit generates a first current. The output circuit generates a reference current based on the first current. A compensation circuit is coupled to the bandgap circuit in parallel at a combination node and generates a compensation current. The compensation current is smaller than the reference current. The reference current has a first temperature coefficient and the compensation current has a second temperature coefficient that is inverse to the first temperature coefficient. The reference current and the compensation current are combined at the combination node, such that an absolute value of a temperature coefficient of the reference voltage of the combination node is smaller than an absolute value of the first temperature coefficient and an absolute value of the second temperature coefficient.

16 Claims, 10 Drawing Sheets

REFERENCE VOLTAGE GENERATING CIRCUITS

CROSS REFERENCE TO RELATED APPLICATIONS

This Application claims priority of Taiwan Patent Application No. 102125349, filed on Jul. 16, 2013, the entirety of which is incorporated by reference herein.

BACKGROUND OF THE INVENTION

1. Field of the Invention

The invention relates to a low temperature coefficient Bandgap reference circuit and the designing methods thereof, and more particularly to circuits and methods for obtaining a stable reference voltage by temperature compensation correction.

2. Description of the Related Art

Bandgap reference circuits are widely used in various circuit design fields for providing stable reference voltages. A bandgap reference circuit may be part of a larger integrated circuit (IC) for providing stable reference voltages to the other circuits in the IC. Therefore, the bandgap reference circuit must be insensitive to temperature and voltage variations.

However, it is actually hard for the reference voltage output by the bandgap reference circuit to remain completely unchanged as temperature varies. Therefore, circuits and methods for obtaining a stable reference voltage by temperature compensation correction are required.

BRIEF SUMMARY OF THE INVENTION

Reference voltage generating circuits are provided. An exemplary embodiment of a reference voltage generating circuit for generating a reference voltage includes a bandgap circuit and a compensation circuit. The bandgap circuit includes a current mirror circuit and an output circuit. The current mirror circuit generates a first current. The output circuit generates a reference current based on the first current. The compensation circuit is coupled in parallel with the bandgap circuit at a combination node for generating a compensation current. The compensation current is smaller than the reference current, the reference current has a first temperature coefficient and the compensation current has a second temperature coefficient that is inverse to the first temperature coefficient, the reference current and the compensation current are combined at the combination node, such that an absolute value of a temperature coefficient of the reference voltage at the combination node is smaller than an absolute value of the first temperature coefficient and an absolute value of the second temperature coefficient.

Another exemplary embodiment of a reference voltage generating circuit for generating a reference voltage includes a bandgap circuit for generating a reference current and a compensation circuit. The bandgap circuit includes a first transistor, a second transistor, a third transistor, a fourth transistor, a fifth transistor, a sixth transistor and a seventh transistor. The first transistor includes a first electrode coupled to an operating voltage. The second transistor includes a first electrode and a second electrode commonly coupled to a second electrode of the first transistor, and a third electrode coupled to a ground node. The third transistor and the fourth transistor form a first current mirror. The fifth transistor includes a first electrode coupled to the fourth transistor, a second electrode coupled to the third transistor and a third electrode coupled to a first resistor. The sixth transistor includes a first electrode coupled to the third transistor a second electrode coupled to the first resistor and a third electrode coupled to the ground node. The seventh transistor includes a first electrode coupled to the operating voltage, a second electrode coupled to the first current mirror and a third electrode coupled to a combination node. The compensation circuit coupled in parallel with the bandgap circuit at the combination node for generating a compensation current. The compensation current is smaller than the reference current, the reference current has a first temperature coefficient and the compensation current has a second temperature coefficient that is inverse to the first temperature coefficient, the reference current and the compensation current are combined at the combination node, such that an absolute value of a temperature coefficient of the reference voltage at the combination node is smaller than an absolute value of the first temperature coefficient and an absolute value of the second temperature coefficient.

A detailed description s given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
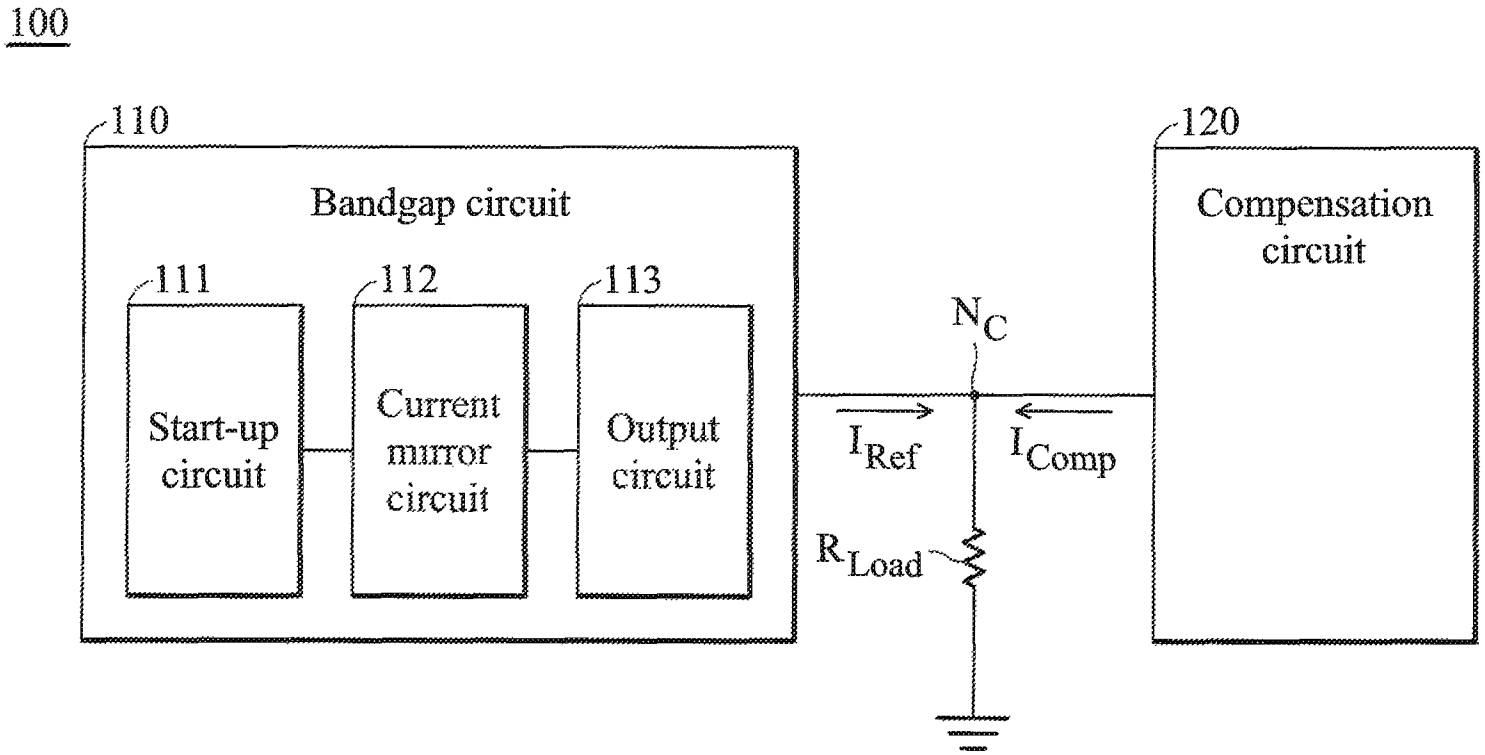
FIG. 1 shows a block diagram of a reference voltage generating circuit according to an embodiment of the invention.

FIG. 1 shows a block diagram of a reference voltage generating circuit according to an embodiment of the invention. The reference voltage generating circuit 100 includes a bandgap circuit 110 and a compensation circuit 120. The bandgap circuit 110 may include a start-up circuit 111, a current mirror circuit 112 and an output circuit 113. The start-up circuit 111 is configured to start up the bandgap circuit 110. The current mirror circuit 112 is configured to generate a first current (the current I1 shown in FIG. 2). The output circuit 113 is configured to generate a reference current $I_{Ref}$ based on the first current. The compensation circuit 120 is configured to generate a compensation current $I_{Comp}$, and is coupled in parallel with the bandgap circuit 110 at a combination node $N_C$. According to an embodiment of the invention, the compensation current $I_{Comp}$ may be designed as a small current that is smaller than the reference current $I_{Ref}$, and may have a temperature coefficient that is inverse to the temperature coefficient of the reference current $I_{Ref}$. For example, when the reference current $I_{Ref}$ has a temperature coefficient that is Proportional To Absolute Temperature (PTAT), the compensation current $I_{Comp}$ has a temperature coefficient that is Inversely Proportional To Absolute Temperature (IPTAT). Similarly, when the reference current $I_{Ref}$ has a temperature coefficient that is IPTAT, the compensation current $I_{Comp}$ has a temperature coefficient that is PTAT.

The reference current $I_{Ref}$ and the compensation current $I_{Comp}$ are combined at the combination node $N_C$ and a reference voltage $V_{Ref}$ is generated at the combination node $N_C$, such that an absolute value of a temperature coefficient of the reference voltage $V_{Ref}$ generated by the reference voltage generating circuit 100 is smaller than an absolute value of the temperature coefficient of the reference current $I_{Ref}$ and an absolute value of the temperature coefficient of the compensation current $I_{Comp}$. For example, in a preferred embodiment of the invention, the reference voltage $V_{Ref}$ generated by the reference voltage generating circuit 100 may have a zero temperature coefficient, or an extraordinarily small temperature coefficient which approaches zero.

Figure 2:
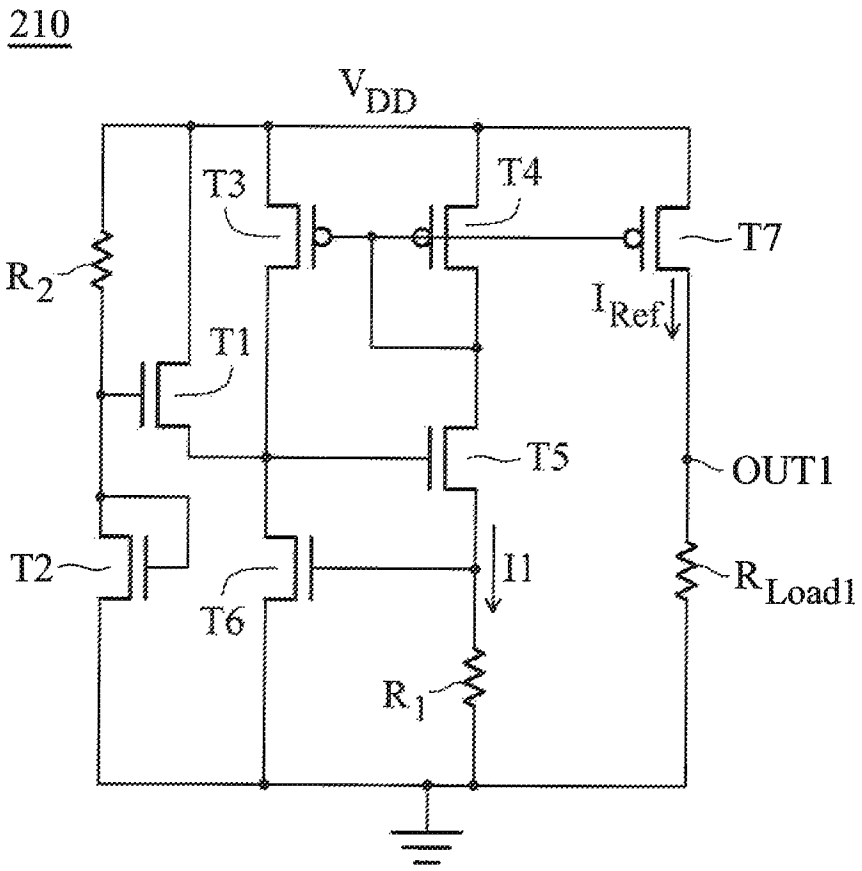
FIG. 2 shows an exemplary circuit diagram of a bandgap circuit according to an embodiment of the invention.

FIG. 2 shows an exemplary circuit diagram of a bandgap circuit according to an embodiment of the invention. The bandgap circuit 210 may include transistors T1~T7 and resistors R1, R2 and $R_{Load1}$. The transistors T1 and T2 and the resistor R2 may form the start-up circuit. The transistors T3, T4, T5 and T6 and the resistor R1 may form the current mirror circuit. The transistor R7 and the resistor $R_{Load1}$ may form the output circuit. In the start-up circuit, the transistor T1 includes a first electrode coupled to an operating voltage. The transistor T2 includes a first electrode and a second electrode commonly coupled to a second electrode of the transistor T1. A third electrode of the transistor T2 is coupled to a ground node. The operating voltage is coupled to the transistors T1 and T2 through the resistor R2. A third electrode of the transistor T1 is coupled to the current mirror circuit. In the current mirror circuit, the transistor T3 and the transistor T4 form a current mirror. The transistor T5 includes a first electrode coupled to the transistor T4, a second electrode coupled to the transistor T3 and a third electrode coupled to the resistor R1. The transistor T6 includes a first electrode coupled to the transistor T3, a second electrode coupled to the resistor R1 and a third electrode coupled to the ground node. In the output circuit, the transistor T7 includes a first electrode coupled to the operating voltage, a second electrode coupled to the current mirror circuit and a third electrode coupled to the output terminal OUT1.

In the embodiments shown in FIG. 2, the transistors T3, T4 and T7 are PMOS transistors, and the transistors T1, T2, T5 and T6 are NMOS transistors. A first terminal of the resistor R2 is coupled to the operating voltage $V_{DD}$. The drain of the transistor T1 is coupled to the operating voltage $V_{DD}$, the gate of the transistor T1 is coupled to the second terminal of the resistor R2 and the source of the transistor T1 is coupled to the transistors T3, T5 and T6. The drain and gate of the transistor T2 are commonly coupled to the gate of the transistor T1, and the source of the transistor T2 is coupled to the ground node. The operating voltage $V_{DD}$ is first provided to the transistors T1 and T2 through the resistor R2, so as to simultaneously turn on the transistors T1 and T2 for starting up the bandgap circuit. The transistors T3 and T4 form a current mirror. The source of the transistor T3 is coupled to the operating voltage $V_{DD}$, the gate of the transistor T3 is coupled to the gate of the transistor T4, and the drain of the transistor T3 is coupled to the transistors T1, T5 and T6. The source of the transistor T4 is coupled to the operating voltage $V_{DD}$, and the gate and drain of the transistor T4 are coupled to each other. The drain of the transistor T4 is further coupled to the transistor T5. The drain of the transistor T5 is coupled to the gate of the transistor T4, the gate of the transistor T5 is coupled to the drain of the transistor T3 and the source of the transistor T5 is coupled to a first terminal of the resistor R1. The drain of the transistor T6 is coupled to the drain of the transistor T3 and the source of the transistor T1, the gate of the transistor T6 is coupled to the first terminal of the resistor R1 and the source of the transistor T6 is coupled to the ground node. A second terminal of the resistor R1 is coupled to the ground node. The source of the transistor T7 is coupled to the operating voltage $V_{DD}$, the gate of the transistor T7 is coupled to the gates of the transistors T3 and T4, and the drain of the transistor T7 is coupled to the output OUT1, The output terminal OUT1 is coupled to a first terminal of the resistor $R_{Load1}$, and a second terminal of the resistor $R_{Load1}$ is coupled to the ground node.

According to an embodiment of the invention, the bandgap circuit 210 may generate a reference current $I_{Ref}$ at the output terminal OUT1, and the amount of the reference current $I_{Ref}$ may be derived from the amount of the first current I1. The amount of the first current I1 may be obtained by dividing the gate-source voltage Vgs of the transistor T6 by the resistance of the resistor R1.

Figure 3:
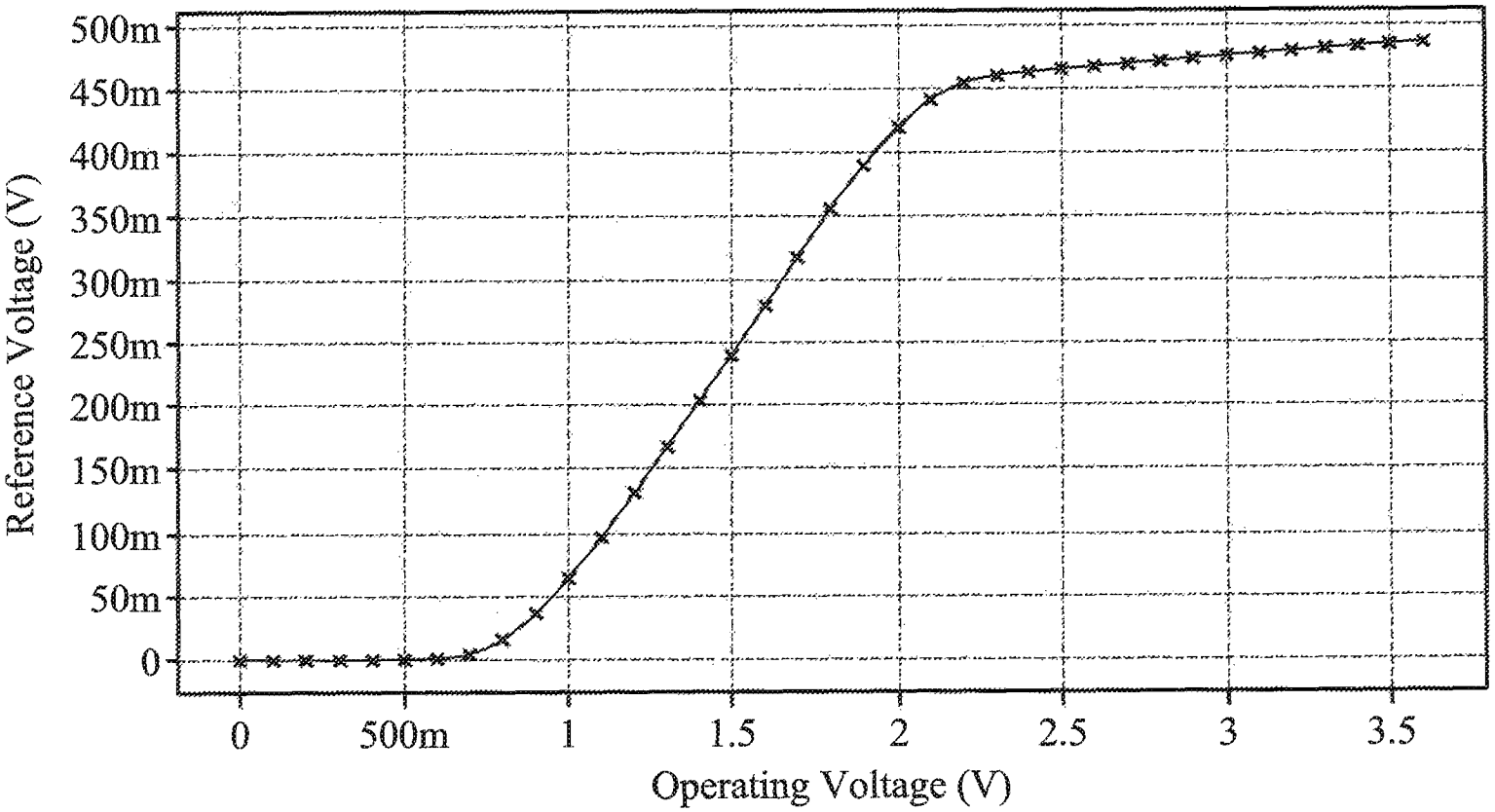
FIG. 3 shows a curve of output voltage of the bandgap circuit versus operating voltage according to an embodiment of the invention.

FIG. 3 shows a curve of output voltage of the bandgap circuit versus the operating voltage according to an embodiment of the invention, where the X axis represents the operating voltage $V_{DD}$ and the Y axis represents the output voltage, such as the output voltage output by the bandgap circuit at the output terminal OUT1 as shown in FIG. 2. As shown in FIG. 3, an important property of the bandgap circuit 210 is that the output voltage is insensitive to the variation of the operating voltage. For example, as shown in FIG. 3, once the operating voltage exceeds a predetermined value, the output voltage substantially does not change as the operating voltage changes.

Figure 4:
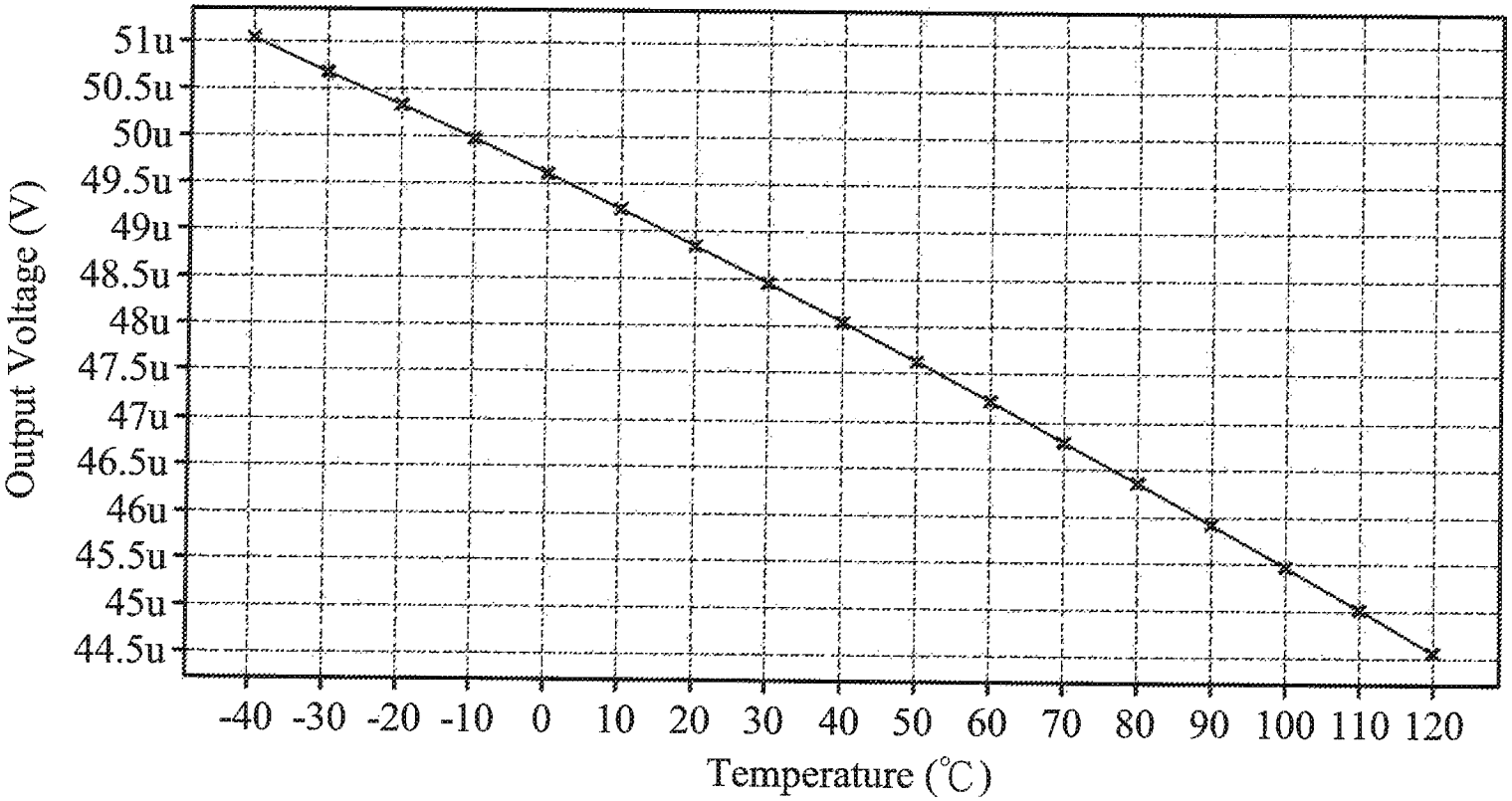
FIG. 4 shows another curve of output voltage of the bandgap circuit versus temperature according to an embodiment of the invention.

FIG. 4 shows another curve of output voltage of the bandgap circuit versus the temperature according to an embodiment of the invention, where the X axis represents the temperature and the Y axis represents the output voltage, such as the output voltage output by the bandgap circuit at the output terminal OUT1 as shown in FIG. 2. In the embodiment, the bandgap circuit 210 has a temperature coefficient that is IPTAT. Therefore, as shown in FIG. 4, the output voltage drops as the temperature rises. Similarly, the reference current $I_{Ref}$ output by the bandgap circuit 210 also has a temperature coefficient that is IPTAT, and the reference current $I_{Ref}$ drops as the temperature rises.

Figure 5:
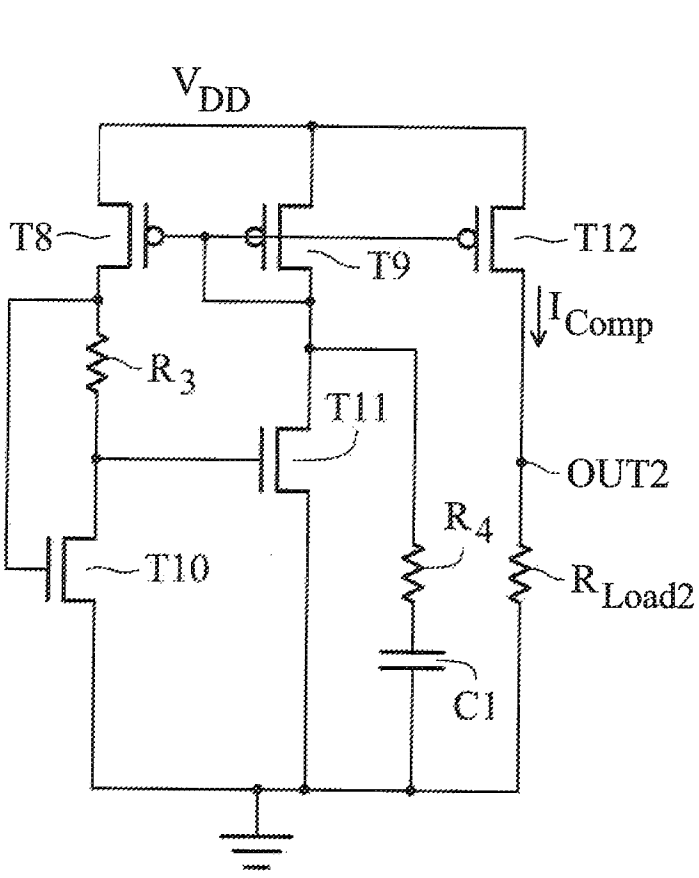
FIG. 5 shows an exemplary circuit diagram of the compensation circuit according to an embodiment of the invention.

FIG. 5 shows an exemplary circuit diagram of the compensation circuit according to an embodiment of the invention. The compensation circuit 520 may include the transistors T8~T12, the capacitor C1 and the resistors R3, R4 and $R_{Load2}$. The compensation circuit 520 may also include a current mirror circuit formed by the transistors T8 and T9. The transistor T11 includes a first electrode coupled to the transistor T9, a second electrode coupled to the transistor T8 through the resistor R3, and a third electrode coupled to the ground node. The transistor 19 is coupled to one terminal of the capacitor C1 though the resistor R4. The other terminal of the capacitor C1 is coupled to the ground node. The transistor T10 includes a first electrode coupled to the transistor T8 through the resistor R3, a second electrode coupled to the transistor 18 and a third electrode coupled to the ground node. In the output circuit of the compensation circuit, the transistor T12 includes a first electrode coupled to the operating voltage, a second electrode coupled to the current mirror circuit formed by the transistors T8 and T9, and a third electrode coupled to the output terminal OUT2.

In the embodiment shown in FIG. 5, the transistors T8, T9 and T2 are all PMOS transistors, and the transistors T10 and T11 are all NMOS transistors. The transistors T8 and T9 form a current mirror. The source of the transistor T8 is coupled to the operating voltage $V_{DD}$, the gate of the transistor T8 is coupled to the gate of the transistor T9, and the drain of the transistor T8 is coupled to the first terminal of the resistor R3. The source of the transistor T9 is coupled to the operating voltage $V_{DD}$, the gate and drain of the transistor T9 are coupled to each other and the drain of the transistor T9 is coupled to the transistor T11. The drain of the transistor T10 is coupled to a second terminal of the resistor R3, the gate of the transistor T10 is coupled to the drain of the transistor T8, and the source of the transistor T10 is coupled to the ground node. The drain of the transistor T11 is coupled to the drain of the transistor T9, the gate of the transistor T11 is coupled to the drain of the transistor T10 and the source of the transistor T11 is coupled to the ground node. The source of the transistor T12 is coupled to the operating voltage $V_{DD}$, the gate of the transistor T12 is coupled to the gates of the transistors T8 and T9, and the drain of the transistor T12 is coupled to the output terminal OUT2. The output terminal OUT2 is coupled to a first terminal of the resistor $R_{Load2}$, and a second terminal of the resistor $R_{Load2}$ is coupled to the ground node. A first terminal of the resistor R4 is coupled to the drain of the transistor T11, a second terminal of the resistor R4 is coupled to a first terminal of the capacitor C1, and a second terminal of the capacitor C1 is coupled to the ground node. The purpose of coupling resistor R4 in serial with the capacitor C1 to the ground node is to further stabilize the compensation circuit.

According to an embodiment of the invention, the compensation circuit 520 may generate a compensation current $I_{Comp}$, at the output terminal OUT2, and the amount of the compensation current $I_{Comp}$ may be derived by the amount of current flowing through the transistors T10 and T11. Referring to FIG. 5, the transistors T10 and T11 are all operating in the sub-threshold region, where the amount of current flowing through the transistors T10 and T11 is obtained by dividing a difference of the gate-source voltage Vgs of the transistor T10 and gate-source voltage Vgs of the transistor T11 by the resistance of the resistor R3.

Figure 6:
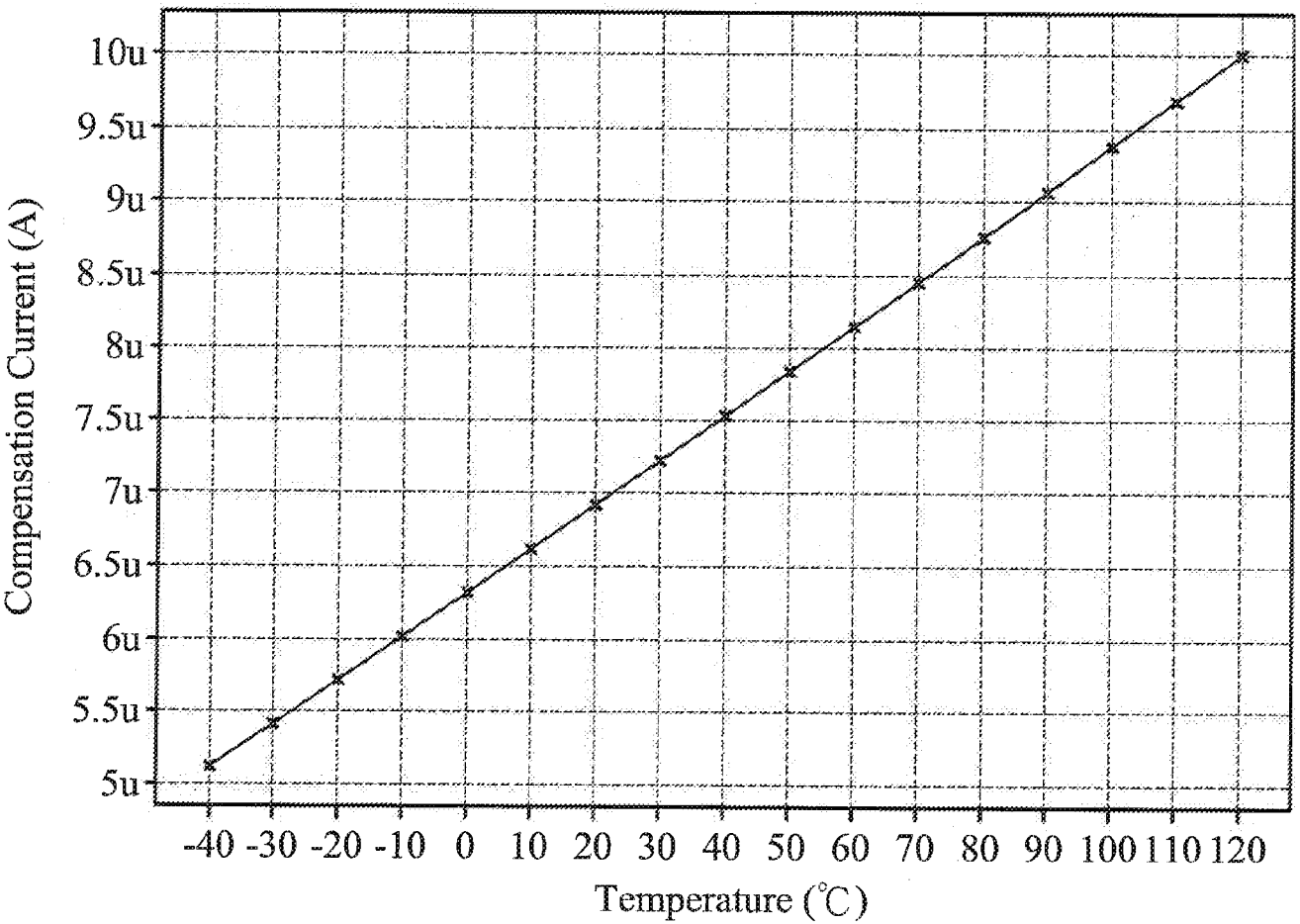
FIG. 6 shows a curve of compensation current of the compensation circuit versus temperature according to another embodiment of the invention.

FIG. 6 shows a curve of compensation current of the compensation circuit versus the temperature according to another embodiment of the invention, where the X axis represents the temperature and the Y axis represents the compensation current, such as the current flowing from the transistor T12 to the output terminal OUT2 and the resistor $R_{Load2}$ as shown in FIG. 5. In the embodiment, since the compensation circuit 520 has a temperature coefficient that is PTAT, and the compensation current rises as the temperature rises as shown in FIG. 6.

Figure 7:
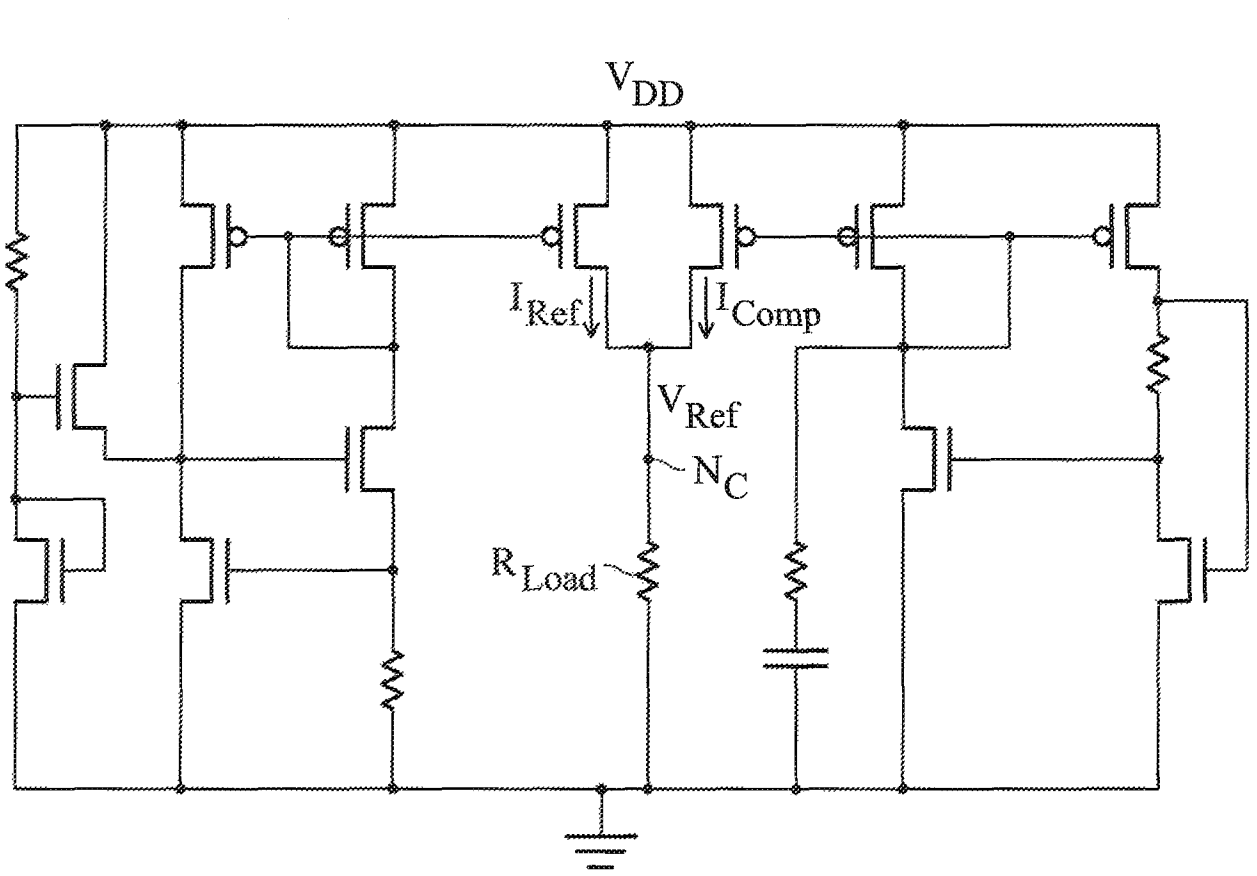
FIG. 7 shows an exemplary circuit diagram of a reference voltage generating circuit according to an embodiment of the invention.

FIG. 7 shows an exemplary circuit diagram of a reference voltage generating circuit according to an embodiment of the invention. The reference voltage generating circuit 700 shown in FIG. 7 is a circuit formed by coupling the bandgap circuit 210 shown in FIG. 2 with the compensation circuit 520 shown in FIG. 5 in parallel, where the resistor $R_{Load}$ represents an equivalent resistor of the resistor $R_{Load1}$ and the resistor $R_{Load2}$ coupled in parallel, and the output terminals OUT1 and OUT2 may be combined as a combination node $N_C$. The reference voltage generating circuit 700 may generate the reference voltage $V_{Ref}$ at the combination node $N_C$. Note that the resistor $R_{Load}$ may also include any resistor configured outside of the bandgap circuit and the compensation circuit, and the invention should not be limited thereto.

According to an embodiment of the invention, the amount of compensation current $I_{Comp}$ may be designed to be much smaller than the amount of reference current $I_{Ref}$, so as to avoid affecting the insensitivity property of the reference current $I_{Ref}$ (that is, the reference current $I_{Ref}$ is insensitive to the variation of the operating voltage). For example, the amount of the compensation current $I_{Comp}$ may he designed as one tenth of the amount of the reference current $I_{Ref}$.

Figure 8:
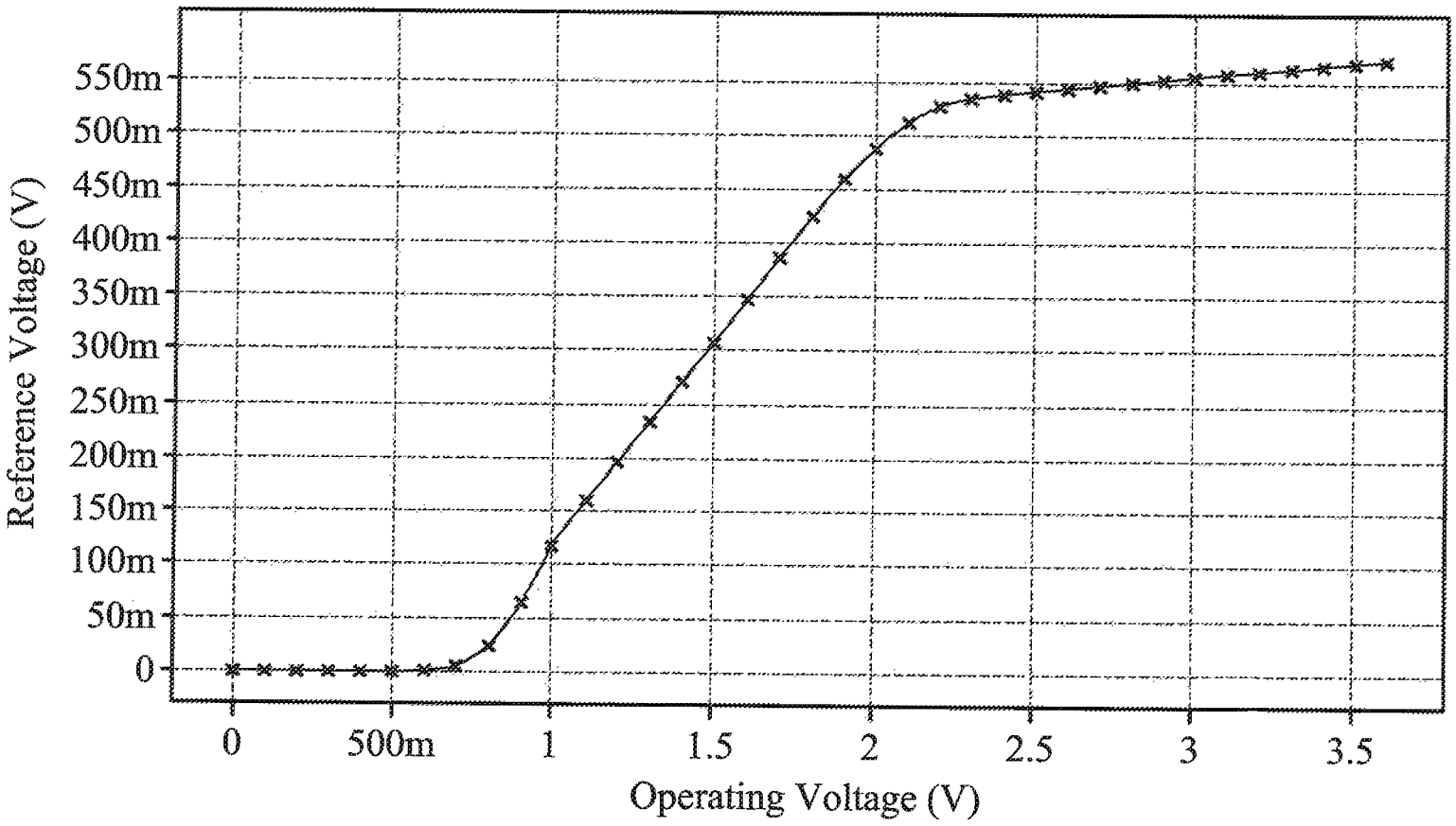
FIG. 8 shows a curve of reference voltage generated by the reference voltage generating circuit versus operating voltage according to an embodiment of the invention.

FIG. 8 shows a curve of reference voltage generated by the reference voltage generating circuit versus the operating voltage according to an embodiment of the invention, where the X axis represents the operating voltage $V_{DD}$ and the Y axis represents the reference voltage $V_{Ref}$. As shown in the figure, the reference voltage generating circuit keeps the important property of the bandgap circuit, that is, the reference voltage $V_{Ref}$ is insensitive to the variation of the operating voltage. For example, as shown in FIG. 8, once the operating voltage exceeds a predetermined value, the reference voltage $V_{Ref}$ substantially does not change as the operating voltage changes.

Figure 9:
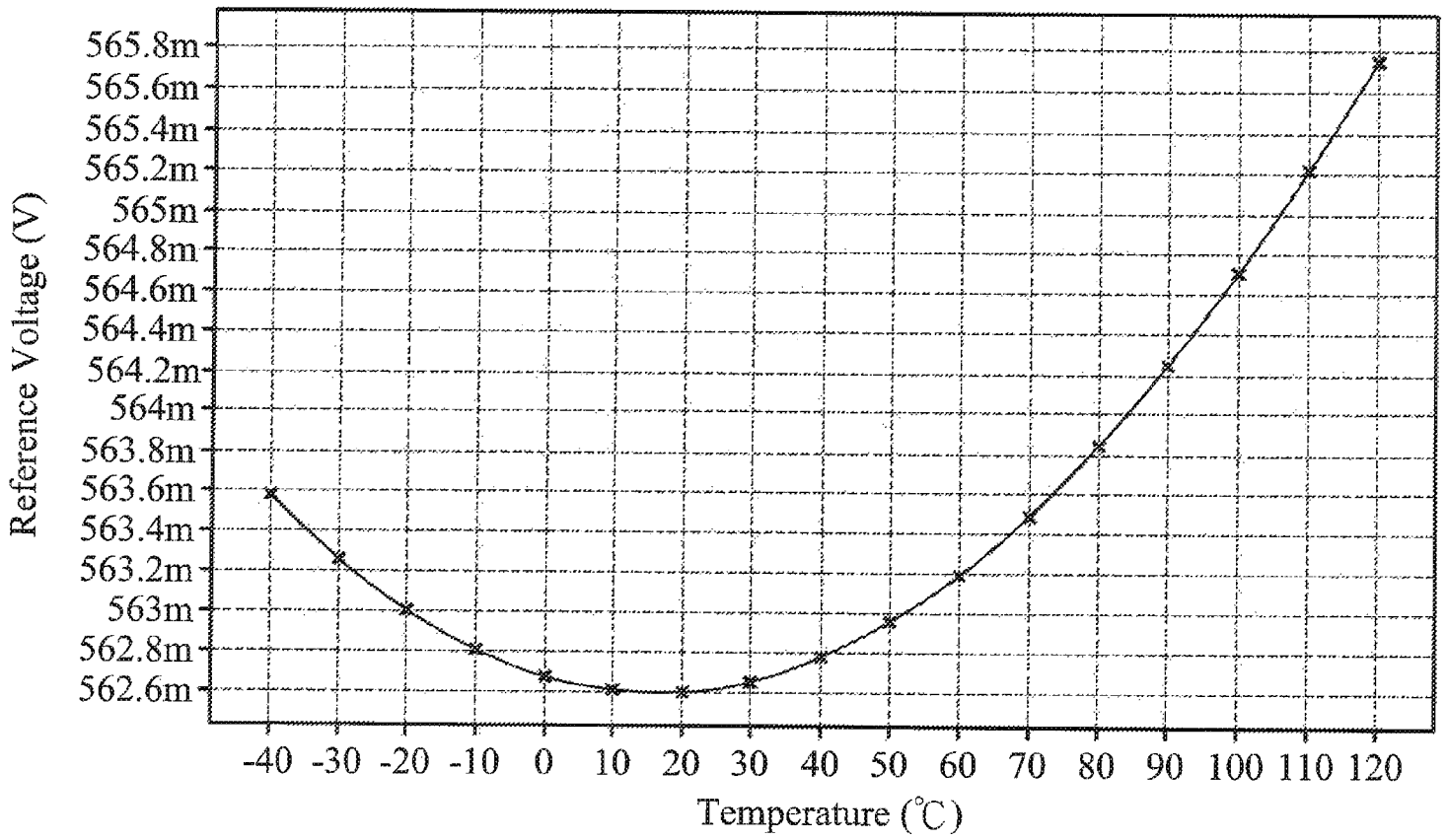
FIG. 9 shows a curve of reference voltage generated by the reference voltage generating circuit versus temperature according to an embodiment of the invention.

FIG. 9 shows a curve of reference voltage generated by the reference voltage generating circuit versus the temperature according to an embodiment the invention, where the X axis represents the temperature and the Y axis represents the reference voltage $V_{Ref}$. As shown in FIG. 9, since the variation of the reference current generated by the bandgap circuit due to rises in temperature may be compensated by adding the compensation current generated by the compensation circuit, the reference voltage $V_{Ref}$ generated by the reference voltage generating circuit becomes insensitive to the temperature variation. For example, as shown in FIG. 9, when the temperature drops to about −40° C., the reference voltage $V_{Ref}$ is about 563.6 mV, and when the temperature rises to about 120° C., the reference voltage $V_{Ref}$ is about 565.8 mV. Note that as the temperature rises by about 160° C., the reference voltage $V_{Ref}$ rises by about only 3.2 mV. Therefore, the reference voltage $V_{Ref}$ substantially remains unchanged as the temperature changes.

In addition, according to an embodiment of the invention, since the reference current $I_{Ref}$ generated by the bandgap circuit and the compensation current $I_{Comp}$ generated by the compensation circuit are combined at the combination node $N_C$, an absolute value of the temperature coefficient of the reference voltage $V_{Ref}$ finally generated by the reference voltage generating circuit 700 is much smaller than an absolute value of the temperature coefficient of the reference current (or, of the bandgap circuit) and an absolute value of the temperature coefficient of the compensation current $I_{Comp}$ (or, of the compensation circuit).

For example, in an embodiment of the invention, the reference current generated by the bandgap circuit at −40° C. is about 50.1 μA. As the temperature rises to 120° C., the reference current drops to about 44 μA. Therefore, a temperature coefficient of the bandgap circuit is IPTAT. On the other hand, the compensation current generated by the compensation circuit at −40° C. is about 5.2 μA, which is about one tenth of the reference current. As the temperature rises to 120° C., the reference current rises to about 10 μA. Therefore, a temperature coefficient of the compensation circuit is PTAT. Under a predetermined amount of temperature variation (for example, from −40° C. to 120° C.), the amount of current variation of the compensation current is almost equivalent to the amount of current variation of the reference current. Since the amount of current variation of the reference current generated by the bandgap circuit may be compensated for by adding the compensation current generated by the compensation circuit, in the embodiment of the invention, after combining the bandgap circuit and the compensation circuit, the absolute value of the temperature coefficient of the resulting reference voltage generated by the reference voltage generating circuit may be much smaller than the absolute value of the temperature coefficient of the bandgap circuit and the absolute value of the temperature coefficient of the compensation circuit.

In addition, since the reference voltage generated by the reference voltage generating circuit is insensitive to the variation of the operating voltage, it is substantially unchanged as the operating voltage changes. Therefore, the reference voltage generating circuit may also be regarded as a bandgap circuit, and as compared to the original bandgap circuit (that is, the bandgap circuit without coupling the compensation circuit), the absolute value of the temperature coefficient may be efficiently and greatly reduced. For example, in a preferred embodiment of the invention, the temperature coefficient of the reference voltage generating circuit may be reduced from 367 ppm/° C. of the original bandgap circuit without coupling the compensation circuit to 19.8 ppm/° C.

Figure 10:
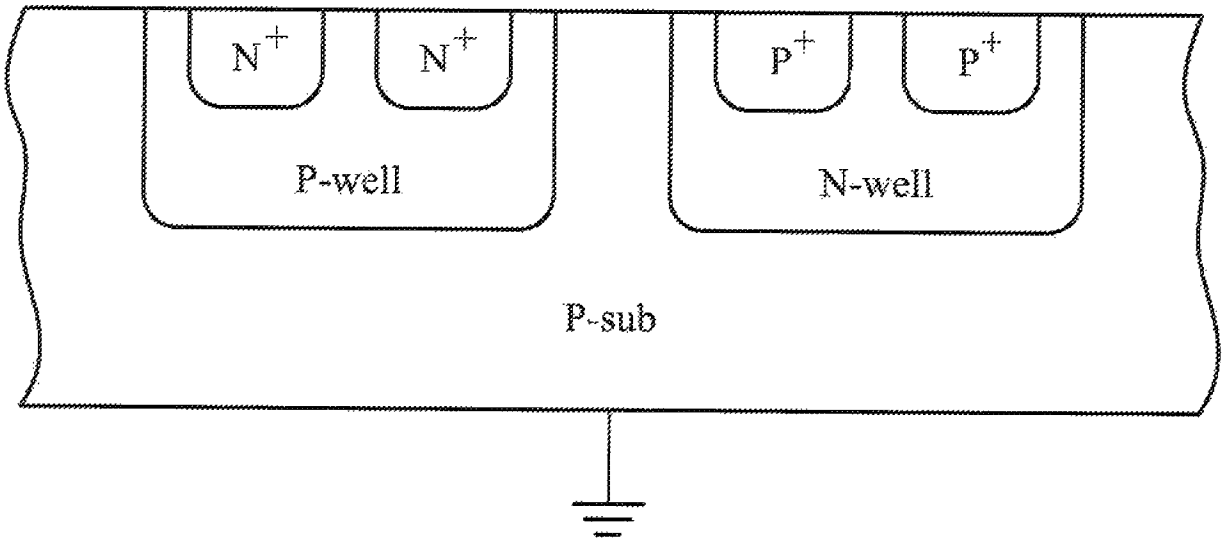
FIG. 10 shows a schematic diagram of a P-substrate twin-well process according to an embodiment of the invention.

According to an embodiment of the invention, the elements in the bandgap circuit and the compensation circuit may be fabricated by a P-substrate N-well or twin-well process. FIG. 10 shows a schematic diagram of a P-substrate twin-well process according to an embodiment of the invention, where the P-sub represents the P-substrate, N-well represents the N well and P-well represents the P well.

In addition, in other embodiments of the invention, based on the designing concept as illustrated above, the bandgap circuit may further couple more than one compensation circuit to form a reference voltage generating circuit, such that the resulting reference voltage generating circuit may have a zero temperature coefficient, or an extraordinarily small temperature coefficient which approaches zero, and the resulting reference voltage generating circuit may still keep the important property of the bandgap circuit. That is, the reference voltage generated by the reference voltage generating circuit is insensitive to the variation of the operating voltage, and remains substantially unchanged as the operating voltage changes.

In addition, in the proposed reference voltage generating circuit, only the transistors, resistors and capacitors are required, and the diode and comparator are not required. Therefore, besides providing a stable reference voltage, the amount of logic gates and circuit area are also greatly reduced as compared to conventional designs.

Use of ordinal terms such as "first", "second", etc., in the claims to modify a claim element does not by itself connote any priority, precedence, or order of one claim element over another or the temporal order in which acts of a method are performed, but are used merely as labels to distinguish one claim element having a certain name from another element having a same name (hut for use of the ordinal term) to distinguish the claim elements.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A reference voltage generating circuit for generating a reference voltage, comprising:

a bandgap circuit, comprising:

a current mirror circuit, for generating a first current; and an output circuit, for generating a reference current based on the first current; and a compensation circuit, with the bandgap circuit coupled in parallel at a combination node for generating a compensation current, wherein the compensation current is smaller than the reference current, the reference current has a first temperature coefficient and the compensation current has a second temperature coefficient that is inverse to the first temperature coefficient, the reference current and the compensation current are combined at the combination node, such that an absolute value of a temperature coefficient of the reference voltage at the combination node is smaller than an absolute value of the first temperature coefficient and an absolute value of the second temperature coefficient.

2. The reference voltage generating circuit as claimed in claim 1, wherein the bandgap circuit further comprises a start-up circuit for starting up the bandgap circuit, the start-up circuit comprises:

a first transistor, comprising a first electrode coupled to an operating voltage; and a second transistor, comprising a first electrode and a second electrode commonly coupled to a second electrode of the first transistor, and a third electrode coupled to a ground node;

wherein a third electrode of the first transistor is coupled to the current mirror circuit.

3. The reference voltage generating circuit as claimed in claim 1, wherein the current mirror circuit comprises:

a third transistor;

a fourth transistor, with the third transistor forming a first current mirror;

a fifth transistor, comprising a first electrode coupled to the fourth transistor, a second electrode coupled to the third transistor and a third electrode coupled to a first resistor; and a sixth transistor, comprising a first electrode coupled to the third transistor, a second electrode coupled to the first resistor and a third electrode coupled to a ground node.

4. The reference voltage generating circuit as claimed in claim 3, wherein the output circuit further comprises:

a seventh transistor, comprising a first electrode coupled to an operating voltage, a second electrode coupled to the first current mirror and a third electrode coupled to the combination node.

5. The reference voltage generating circuit as claimed in claim 1, wherein the compensation circuit comprises:

an eighth transistor;

a ninth transistor, with the eighth transistor forming a second current mirror;

a tenth transistor, comprising a first electrode coupled to the eighth transistor through a second resistor, a second electrode coupled to the eighth transistor and a third electrode coupled to the ground node;

an eleventh transistor, comprising a first electrode coupled to the ninth transistor, a second electrode coupled to the eight transistor through the second resistor, and a third electrode coupled to the ground node; and a twelfth transistor, comprising a first electrode coupled to the operating voltage, a second electrode coupled to the second current mirror and a third electrode coupled to the combination node.

6. The reference voltage generating circuit as claimed in claim 5, wherein the compensation circuit further comprises:

a third resistor, having a first terminal coupled to the ninth transistor and another terminal coupled in serial with a capacitor to the ground node.

7. The reference voltage generating circuit as claimed in claim 1, wherein an amount of the compensation current is about one tenth of an amount of the reference current.

8. The reference voltage generating circuit as claimed in claim 1, wherein under a predetermined amount temperature variation, an amount of current variation of the compensation current is substantially the same as an amount of current variation of the reference current.

9. The reference voltage generating circuit as claimed in claim 1, wherein the bandgap circuit and the compensation circuit are fabricated by a P-substrate N-well or twin-well process.

10. A reference voltage generating circuit for generating a reference voltage, comprising:

a bandgap circuit, for generating a reference current, comprising:

a first transistor, comprising a first electrode coupled to an operating voltage;

a second transistor, comprising a first electrode and a second electrode commonly coupled to a second electrode of the first transistor, and a third electrode coupled to a ground node;

a third transistor;

a fourth transistor, with the third transistor forming a first current mirror;

a fifth transistor, comprising a first electrode coupled to the fourth transistor, a second electrode coupled to the third transistor and a third electrode coupled to a first resistor;

a sixth transistor, comprising a first electrode coupled to the third transistor, a second electrode coupled to the first resistor and a third electrode coupled to the ground node; and a seventh transistor, comprising a first electrode coupled to the operating voltage, a second electrode coupled to the first current mirror and a third electrode coupled to a combination node; and a compensation circuit, with the bandgap circuit coupled in parallel at the combination node for generating a compensation current, wherein the compensation current is smaller than the reference current, the reference current has a first, temperature coefficient and the compensation current has a second temperature coefficient that is inverse to the first temperature coefficient, the reference current and the compensation current are combined at the combination node, such that an absolute value of a temperature coefficient of the reference voltage at the combination node is smaller than an absolute value of the first temperature coefficient and an absolute value of the second temperature coefficient.

11. The reference voltage generating circuit as claimed in claim 10, wherein the compensation circuit comprises:

an eighth transistor;

a ninth transistor, with the eighth transistor forming a second current mirror;

a tenth transistor, comprising a first electrode coupled to the eighth transistor through a second resistor, a second electrode coupled to the eighth transistor and a third electrode coupled to the ground node;

an eleventh transistor, comprising a first electrode coupled to the ninth transistor, a second electrode coupled to the eighth transistor through the second resistor, and a third electrode coupled to the ground node; and a twelfth transistor, comprising a first electrode coupled to the operating voltage, a second electrode coupled to the second current mirror and a third electrode coupled to the combination node.

12. The reference voltage generating circuit as claimed in claim 11, wherein the compensation circuit further comprises:

a third resistor, having a first terminal coupled to the ninth transistor and another terminal coupled in serial with a capacitor to the ground node.

13. The reference voltage generating circuit as claimed in claim 10, wherein the reference voltage has substantially a zero temperature coefficient.

14. The reference voltage generating circuit as claimed in claim 10, wherein under a predetermined amount of temperature variation, an amount of current variation of the compensation current is substantially the same as an amount of current variation of the reference current.

15. The reference voltage generating circuit as claimed in claim 10, wherein an amount of the compensation current is about one tenth of an amount of the reference current.

16. The reference voltage generating circuit as claimed in claim 10, wherein the bandgap circuit and the compensation circuit are fabricated by a P-substrate N-well or twin-well process.

* * * * *